United States Patent [19]

McNabb

[11] 4,062,792

[45] Dec. 13, 1977

[54] SOAP CAKE CONSTRUCTION AND MANUFACTURE

[76] Inventor: Charles L. McNabb, 1347 W. Chase, Chicago, Ill. 60626

[21] Appl. No.: 690,563

[22] Filed: May 27, 1976

[51] Int. Cl.[2] ..... C11D 17/04; C11D 13/14

[52] U.S. Cl. ..... 252/93; 15/104.93; 252/90; 252/91; 252/92; 252/134; 252/DIG. 16

[58] Field of Search ..... 252/90, 92, 93, 134, 252/174, DIG. 16; 401/266, 201; 15/222, 104.93; 206/.5

[56] References Cited

U.S. PATENT DOCUMENTS

| | | | |
|---|---|---|---|
| 581,920 | 5/1897 | Samuel | 252/92 |
| 1,292,982 | 1/1919 | Wolf | 401/266 |
| 1,478,882 | 12/1923 | Bailly | 252/92 |
| 1,782,859 | 11/1930 | Perego | 401/201 |
| 1,909,966 | 5/1933 | Jones | 252/93 |
| 2,083,871 | 5/1937 | Serewicz | 15/122 |
| 2,269,871 | 1/1942 | Bothelho | 252/128 X |
| 3,196,112 | 7/1965 | Presley | 252/92 |

FOREIGN PATENT DOCUMENTS

| | | |
|---|---|---|
| 835,913 | 3/1970 | Canada. |
| 1,027,514 | 5/1953 | France. |
| 1,110,203 | 2/1956 | France. |
| 222,997 | 10/1924 | United Kingdom. |
| 955,039 | 4/1964 | United Kingdom. |

*Primary Examiner*—P.E. Willis, Jr.
*Attorney, Agent, or Firm*—David D. Kaufman

[57] ABSTRACT

A soap cake comprising a thin support plate permanently fixed between a pair of soap halves which are integrated through openings in the plate. The plate extends peripherally from the soap halves providing a flange for better purchase. In another form, an elastic sponge-like cover is stretched over the soap cake and permanently secured to the support plate flange. An alternative method of making the covered soap cake is taught wherein the stretchable container is used as a form of expansible mold for injecting thereinto liquid or plastic soap.

6 Claims, 7 Drawing Figures

SOAP CAKE CONSTRUCTION AND MANUFACTURE

This invention relates to the manufacture and use of bar or cake soap and more particularly to a new and improved soap cake structure and methods of manufacturing the same.

With all of its recognized shortcomings, the conventional soap bar or cake has nonetheless remained virtually unchanged in physical appearance and structure over the years. Thus, for example, the hand held soap cake still becomes slippery when wet, causing it frequently to squirt or fall from the hands of the user. Drying of the soap cake between uses is difficult because it is placed in a soap dish or the like which invariably contains some water. This results in a wasteful softening and dissolution of the bottom of the cake. Lathering of the bare soap cake in the hands of the user is of itself wasteful because much of the lather is either washed away under the faucet or is transferred to the receptacle into which the wet cake is placed after use. Of course, effective application of the lather to the body of the user, or other object being washed, normally requires an additional device, such as a wash cloth or brush. The cake frequently wears unevenly creating shapes and forms which are even more difficult to handle although a goodly portion remains to be used. When the cake is reduced to a relatively thin sliver or other small shape, it frequently cracks or crumbles into unusable and wasted fragments.

Efforts to combat these commonly encountered problems with cake soap have been attempted in the past, but with limited success, if any. In the main, these efforts have taken the form of containers, either disposable or reusable, for the soap cake. Representative of such prior devices are patents such as Wolf, U.S. Pat. No. 1,292,982, a pre-packaged textile casing with draw strings which is then usable as a soap applicator. Schick, U.S. Pat. No. 2,139,175, teaches a metal dishcloth having means for inserting a soap cake therein. Shont, U.S. Pat. No. 1,334,716, shows an elongated body or back scrubbing bath strap having a pocket for inserting a soap cake therein. Clanton, U.S. Pat. Nos. 2,319,847 and 2,339,000, teach reusable holders comprising a lattice of textile or rubber, the former having a zipper to retain the inserted soap cake therein. To my knowledge, none of these prior devices are in substantial or widespread use today.

It is a principal object of this invention to provide a soap cake structure which overcomes or greatly alleviates problems of the type alluded to above. A related object is to provide methods of manufacturing cake soap which may be readily and inexpensively incorporated into or used in conjunction with any of the conventional industrial soap making techniques.

Another object is to to provide a soap cake and methods of manufacture of the character described wherein the soap cake may take one of two forms, that is, bare or uncovered for hand lathering use in the customary fashion, and pre-packaged in a container which serves as a combination lather applicator and scrubber.

A further object is to provide a soap cake and manufacturing methods of the character described in which the soap cake has means for hanging the same from a hook or the like after use for air drying.

Still another object is to provide a soap cake and manufacturing methods of the character described wherein the pre-packaged container-applicator-scrubber may be employed as a form of mold in the soap manufacturing method. A related object is to provide such soap and methods wherein less expensive manufacturing processes and normally inferior or rejectable forms of soap may be employed.

Yet another object is to provide a soap cake and manufacturing methods of the character described wherein the container-applicator-scrubber may be employed by the manufacturer for permanent application thereto of trademarks, advertising data, or the like.

Still a further object is to provide a soap cake and manufacturing methods of the character described wherein the container-applicator-scrubber conforms closely to the soap cake at all times as the same is being used up.

Yet a further object is to provide a soap cake and manufacturing methods of the character described having means for easier and surer gripping of the cake and for insuring efficient total utilization thereof without waste and which nonetheless do not add appreciably, if at all, to the cost of the finished product.

With the foregoing and other objects in view which will appear as the description proceeds, the invention comprises most generally, a soap cake having integrated therein a thin, flexible, substantially planar member in the nature of a lath or support plate. The support plate is formed with one or more holes therethrough so that the two sections of soap cake on opposite sides thereof may be pressed together while in a plastic state to fuse together and form the integrated structure. The support plate has the general plan configuration of the soap cake and has a perimetric or partial flange extending from and around the cake.

In other embodiments of the invention, the support plate is pre-formed with a stretchable casing or sponge-like cover members on both sides thereof to provide an expansible container. The support plate is also formed with an orifice or mouth affording an inlet to the expansible container. During manufacture, the soap in liquid or plastic form is injected into the stretchable container which functions as a mold in which the soap sets. The mouth is then sealed closed and may be cut off or punched with a hole for hanging, and the container functions as a combination applicator-scrubber in use. Alternatively, the soap cake structure is made by pressing together as first described and then the casing or pair of cover members is stretched thereover and connected to the perimetric flange as by suitable adhesives, welding or mechanical means.

For the purpose of facilitating an understanding of my invention, I have illustrated in the accompanying drawings preferred embodiments thereof, from an inspection of which, when considered in connection with the following description, my invention, its modes of construction, manufacture and operation, and many of its advantages should be readily understood and appreciated.

Referring to the drawings in which the same characters of reference are employed to indicate corresponding or similar parts throughout the several figures of the drawings.

Figure 1:
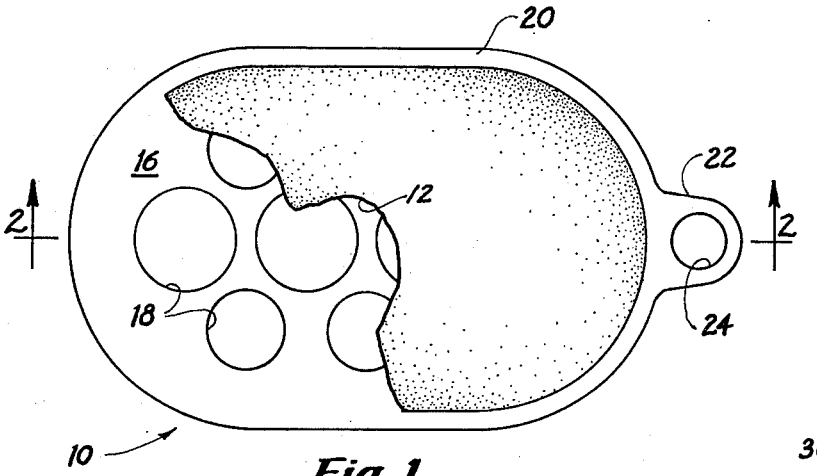
FIG. 1 is a top plan view of a soap cake made in accordance with the principles of the invention with portions being broken away to show internal details of construction.
Figure 2:
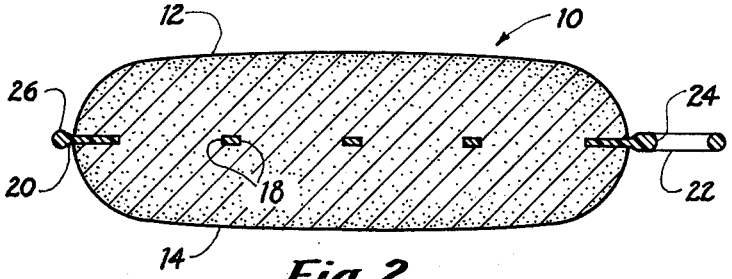
FIG. 2 is a vertical sectional view taken on the plane of line 2—2 in FIG. 1 and viewed in the direction indicated.

Turning with greater particularity to FIGS. 1 and 2 of the drawings, it will be seen that the reference character 10 indicates generally a soap cake embodying the principles of the inventive structure and methods of manufacture. Soap cake 10 comprises an upper soap segment 12 and lower soap segment 14 having a planar support plate 16 embedded or fixed therebetween. Support plate 16 is formed with a plurality of flow holes 18 which serve to integrate the soap segments 12 and 14 into a unitary structure. Under normal manufacturing conditions, the soap segments 12 and 14 will be equal in size and comprise halves of the cake 10, and the plate 16 will define a medial plane between the halves.

During manufacture, the two soap segments such as 12 and 14 are placed, while in a sufficiently soft or plastic state, in a pair of opposed, appropriately shaped dies. The two soap segments then are simultaneously pressed against opposite sides of the plate 16. Through the holes 18, the two plastic soap segments fuse together and, upon cooling and hardening, form the permanently integrated soap cake 10.

The support plate 16 has the same general configuration as the soap segments 12 and 14 but is larger in dimension to provide a perimetric flange 20. The flange 20 may also include an end extension such as 22 provided with a hole 24, or a hook form (not shown), for hanging the soap cake from a suitable hanger or support. The flange 20 is likewise formed with a peripheral enlarged or rounded bead 26, which may be smooth as shown or serrated or knurled if desired.

The support plate 16 is thin (on the order of 0.010 to 0.050 inch) and slightly flexible, and to this end may be made of any suitable plastics, such as, polyvinyls, polyethylenes, and the like. In use, the flange 20 affords better purchase to prevent slippage from the hands of the user of the cake. In this regard, the moderate flexibility of the plate 16 and the rounded peripheral bead 26 facilitate handling of the soap cake during lathering in the hands of the user. By means of the extension 22 and hole 24, the soap cake may be suspended from an appropriate support for air drying between uses. As the soap material is used and consumed, the support plate 16 serves additionally to support and prevent breakage of even a relatively thin sliver, thereby enabling efficient use of the entire soap cake. It will also be appreciated that the plate affords an easy-to-grip, fixed dimension object irrespective of how much the soap segments have been reduced in size.

Figure 3:
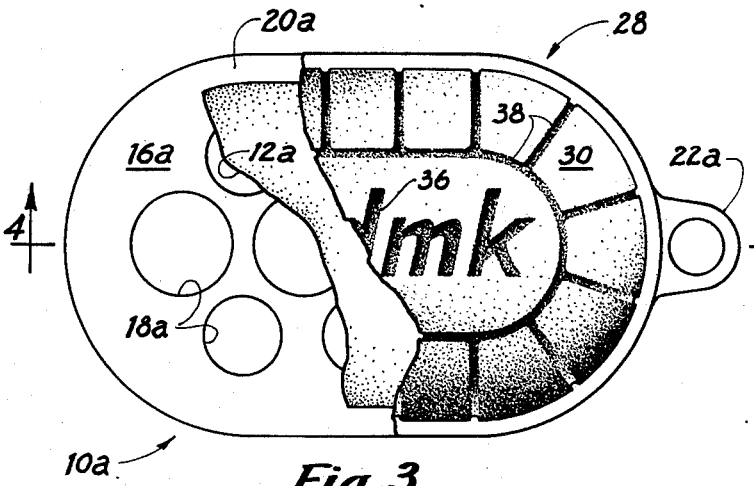
FIG. 3 is a top plan view of another form of the soap cake of FIG. 1, with portions broken away to show internal details of construction.
Figure 4:
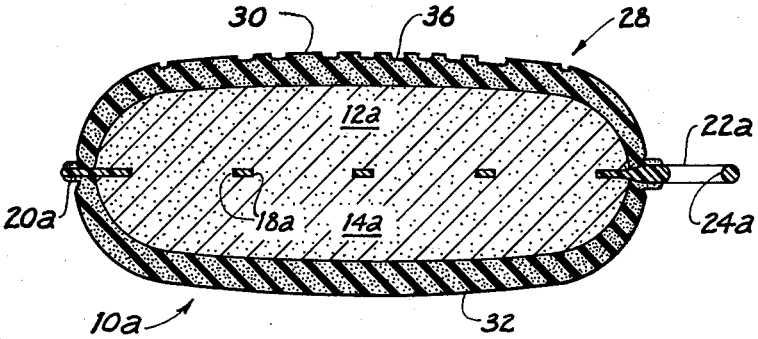
FIG. 4 is a vertical sectional view taken on the plane of line 4—4 in FIG. 3 and viewed in the direction indicated.

When the soap cake 10 is fully cooled and hardened, the same may comprise the finished product and be used as described, that is, uncovered. However, the invention further contemplates pre-packaging the soap cake in a permanent cover which then serves as a combination applicator-scrubber in use. Turning to FIGS. 3 and 4 of the drawings, there is illustrated this embodiment of the invention wherein like parts are identified with like numerals but with the suffix "*a*" added.

Pre-packaged soap cake 10*a* thus comprises a pair of soap halves 12*a* and 14*a* fused together as already described and having the support plate 16*a* embedded therebetween. A cover 28 permanently encases the soap cake 10*a*, said cover preferrably comprising a pair of elastic cover members 30 and 32 which are stretched over the soap halves with the peripheral edges thereof being permanently connected to the plate 16*a* by any suitable means, such as adhesives or known welding or other mechanical techniques. The soap halves and support plate are thereby permanently sealed with the cover 28 formed by the members 30 and 32.

The cover members 30 and 32 preferrably comprise stretchable sheets of sponge-like plastics made in well known manner by foaming of various plastics such as polystyrenes, polyurethanes, polypropylenes, and the like. The cover members thus are porous like a sponge and function ideally as an aerating suds maker as well as a lather applicator and scrubber. Being sponge-like in nature, they also permit efficient air drying of the soap cake between uses. It will likewise be appreciated that, owing to their elasticity, the cover members will tend to draw snugly over the soap as it shrinks in size during use. Consequently, the soap cake 10*a* may be efficiently used, without substantial movement or slippage between soap and cover, until the soap is totally consumed.

As indicated in FIGS. 3 and 4, the cover members 30 and 32 have other advantages in addition to those already described. Thus, for example, they may be permanently imprinted with the manufacturer's trademark or advertising material 36 and also be provided with grooves or depressions such as 38 arranged in interesting or decorative patterns. Of course, these features are permanently carried by the cover and are visible to the user until the soap cake is used up and the empty container discarded.

Figure 5:
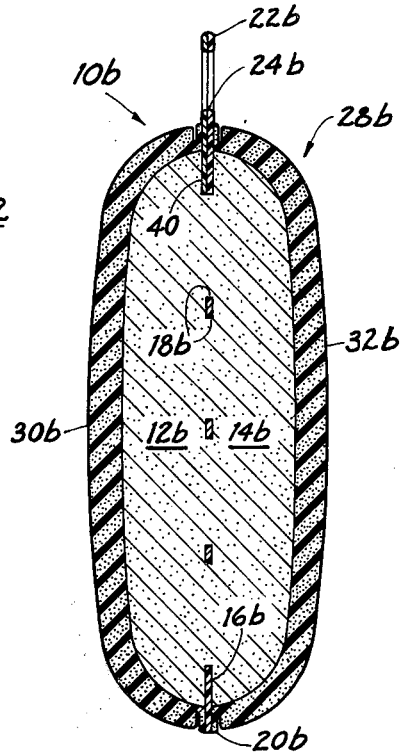
FIG. 5 is a vertical sectional view, similar to FIG. 4, but illustrating a soap cake made in accordance with another embodiment of the inventive method of manufacture.
Figure 7:
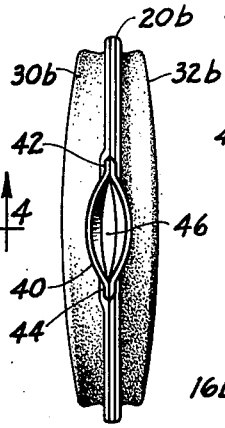
FIG. 7 is an end elevation viewed from the direction indicated in FIG. 6.
Figure 6:
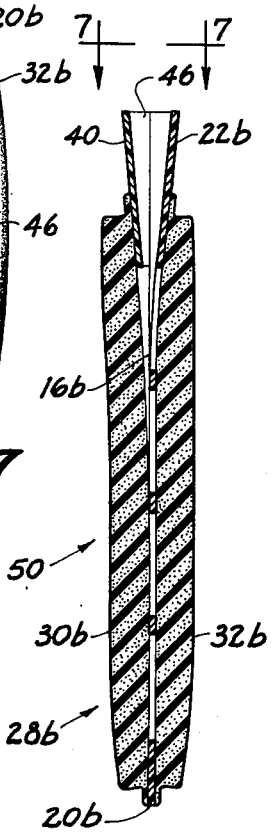
FIG. 6 is a similar view, but illustrating the support plate and attached cover members in collapsed condition prior to injecting the plastic soap.

Still another embodiment of the inventive soap cake structure and manufacturing method is illustrated in FIGS. 5, 6 and 7, wherein similar parts are identified with similar reference numerals but with the suffix "*b*" added. Soap cake 10*b* comprises soap halves 12*b* and 14*b* having support plate 16*b* embedded therebetween. The completed soap cake likewise comprises stretched cover members 30*b* and 32*b* permanently secured, as by adhesives, welding, or other mechanical means, to the peripheral flange 20*b* of the support plate 16*b*.

In this embodiment, the plate end extension 22*b* has an overlay flap 40 of like plastic material connected thereto at its lateral edges 42, 44, to provide an injection mouth or orifice 46. According to the invention, the support plate 16*b* and connected cover members 30*b* and 32*b* are pre-formed into the collapsed structure 50 shown in FIG. 6. Structure 50 is placed in a support mold shaped to form the final soap cake configuration desired, preferrably with the injection mouth 46 opening upwardly. A measured charge of liquid or plastic soap is then injected into the mouth 46, which soap fills the mold and stretches the cover members 30*b* and 32*b* into the final soap cake conforming configuration. After soap injection, the plate 16*b* and overlay flap 40 are welded together, or adhered, to form the double thickness extension 22b which may then be punched to provide a hole 24b for hanging. Alternatively, the end extension 22b may be die cut to provide a hook shape or trimmed off entirely. It will be appreciated that when the plastic soap is injected as described, it flows through the support plate openings 18b to form a homogeneous mass which then hardens and sets into the integrated soap cake structure described in the earlier embodiments.

With regard to the uncovered embodiment of FIG. 1, it will be understood that, depending upon the soap cake's configuration, the flange 20 need not extend completely around the perimeter of the soap cake. Thus, for example, where the soap cake is rectangular or elongated oval, as illustrated, flanges extending only along the opposite longitudinal sides will suffice.

In the embodiments of FIGS. 3 through 7, the permanent and sealed cover obviously functions during use as a combination lather applicator and scrubber. Since the soap itself is concealed, it is feasible to use soap which is less than cosmetically perfect and might otherwise be rejected for uncovered consumer use. Also, the sponge-like cover enhances the lathering or suds-making characteristics of the soap so that less expensive and less desirable soap materials may be employed. While the sponge-like cover has been described as comprising two separate cover members connected to opposite faces of the support plate, the cover obviously could also comprise a one-piece sheath or envelope connected to the peripheral edge of the plate.

In all embodiments, it should be appreciated that the shape and number of holes 18 may be varied as desired, it being understood that even a single hole of proper shape and size will function in the manner described.

I claim:

1. A soap cake comprising:

a pair of soap segments;

a substantially planar support plate fixed between said soap segments;

said support plate having an opening formed therein and said soap segments being fused together and integrated through said opening;

said support plate being of substantially the same configuration but larger dimension than said soap segments to provide a fixed dimension perimetric flange extending outwardly from said soap segments; and an elastic, porous cover connected to said flange and encasing said soap segments in permanently sealed relationship;

said cover being stretched over the soap segments whereby the same retains a substantially close, contouraccommodating relationship as the latter reduce in size during use.

2. A soap cake according to claim 1 in which said cover comprises a pair of elastic, porous members secured, respectively, to opposite faces of said flange.

3. A soap cake according to claim 1 and comprising further means on said flange for hanging said soap cake from a support.

4. A method of making a soap cake characterized by the steps of:

positioning a pair of soap segments in a plastic state on opposite sides of a relatively thin, substantially planar plate having an opening formed therein;

said plate being of larger dimension than said soap segments and extending outwardly therefrom in a fixed dimension perimetric flange;

pressing said soap segments together against said plate to fuse said soap segments together through said opening; allowing said soap segments to harden into an integrated structure with the plate fixed therebetween;

stretching an elastic, porous cover over said soap segments; and permanently securing said cover to said flange.

5. A method of making a soap cake characterized by the steps of:

injecting soap in a plastic state into an expansible container, said container comprising a relatively thin, substantially planar plate having an opening therein; an elastic, porous casing secured to the plate around the perimeter thereof; and an injection orifice communicating with the interior of said container, discontinuing injection of soap when the container has stretched to a pre-determined size;

permanently sealing closed said orifice; and allowing the soap to set and harden.

6. A method according to claim 5 and characterized further by the step of treating the sealed orifice to provide means for hanging said soap cake from a support.

* * * * *